US006736631B2

(12) United States Patent
Ferlin et al.

(10) Patent No.: US 6,736,631 B2
(45) Date of Patent: May 18, 2004

(54) SEALED GAS BURNER

(75) Inventors: William J. Ferlin, Franklin, TN (US); Samuel D. Hawkins, Lebanon, OH (US)

(73) Assignee: Mueller Industries, Inc., Memphis, TN (US)

( * ) Notice: Subject to any disclaimer, the term of this patent is extended or adjusted under 35 U.S.C. 154(b) by 149 days.

(21) Appl. No.: 10/094,683

(22) Filed: Mar. 11, 2002

(65) Prior Publication Data

US 2003/0170580 A1 Sep. 11, 2003

(51) Int. Cl.[7] ..... F24C 3/10
(52) U.S. Cl. ..... 431/266; 126/39 E
(58) Field of Search ..... 431/266, 263, 431/264, 269, 354; 126/39 E, 39 R, 39 J, 39 B, 39 K

(56) References Cited

U.S. PATENT DOCUMENTS

| | | | | |
|---|---|---|---|---|
| 5,133,658 A | | 7/1992 | Le Monnier De Gouville et al. | 431/349 |
| 5,152,276 A | * | 10/1992 | Brock et al. | 126/39 E |
| 5,246,365 A | * | 9/1993 | Himmel et al. | 431/263 |
| 5,397,234 A | * | 3/1995 | Kwiatek | 431/264 |
| 5,443,380 A | * | 8/1995 | Riehl | 431/266 |
| 5,468,145 A | | 11/1995 | Ferlin | 431/266 |
| 5,704,777 A | * | 1/1998 | Measom | 126/39 J |
| 5,865,615 A | | 2/1999 | Simpson et al. | 431/266 |
| 6,131,561 A | | 10/2000 | Maxwell et al. | 126/39 R |
| 6,254,381 B1 | * | 7/2001 | Baynham et al. | 431/266 |

FOREIGN PATENT DOCUMENTS

| | | | | |
|---|---|---|---|---|
| FR | 2 408 096 A | * | 6/1979 | F23Q/3/00 |
| JP | 63-58009 A | * | 3/1988 | |

* cited by examiner

*Primary Examiner*—Josiah Cocks
(74) *Attorney, Agent, or Firm*—Harness, Dickey & Pierce, P.L.C.

(57) ABSTRACT

A sealed gas burner for a cooking range has a venturi tube assembly which is attached directly to a range top of the cooking range. A burner cup slidingly and releasably engages a venturi tube of the venturi tube assembly which extends through the range top. A burner cap releasably engages the burner cup and it defines a plurality of burner ports. The burner cup and the burner cap define an annular gas chamber in communication with the burner ports. The burner ports can be cleaned by removing only the burner cap. Additional cleaning of the burner and the range top can be accomplished by removing both the burner cap and the burner cup.

42 Claims, 3 Drawing Sheets

SEALED GAS BURNER

FIELD OF THE INVENTION

The present invention relates to sealed gas burners for cooking ranges. More particularly, the present invention relates to a simplified sealed gas burner which is more economical to produce and which can be easily removed from the cooking range in order to facilitate the cleaning of both the gas burner and the cooking range.

BACKGROUND AND SUMMARY OF THE INVENTION

Conventional domestic household cooking ranges are generally comprised of a planar range top and a plurality of sealed burners. These gas burners can be divided into two styles, the first being an open cook top burner and the second being a sealed cook top burner. Open cook top burners are normally supported by structure which is located below the range top and the burner extends through a burner opening in the range top. There is an annular space or clearance that exists between the burner head and the burner opening. This annular space or opening can vary in width from one-half of an inch to one and one-half inches and over the years this has presented problems to the range designers, the range manufacturers and the end users of the range. This annular space or clearance can allow food spills to fall through to the underlying burner box and this annular space or clearance can also provide a non-intended opening for flue products to vent, especially when an oven or any other burner compartment located below the top section begins to operate. Sealed gas burners have been developed to overcome some of these problems.

Sealed gas burners are secured in place within one or more apertures with the outer periphery of the sealed gas burner mating with the range top to eliminate any type of annular space or clearance between the burner and the range top. The elimination of this annular space or clearance stops food spillage from dropping into the burner box below the range top and it eliminates any problems associated with the venting of flue products. The sealed gas burner provides a clean streamlined appearance which facilitates both the cleaning and the maintenance of the range top.

A typical prior art sealed gas burner assembly includes a die cast metal burner body which is covered by a removable die cast metal top to form a gas chamber. The burner body includes a sidewall having a plurality of burner ports formed therein and through which the primary air/gas mixture is passed to the exterior of the burner body for combustion. Other typical prior art sealed gas burner designs include a stamped burner top which is crimped to a stamped burner base to form the sealed gas chamber.

A major disadvantage to these prior art designs for sealed gas burners has been the difficulty of the procedure required when cleaning the cooking range, the burner assembly and the overall costs involved with their manufacture. The burner assemblies having a removable top allowed access to the gas chamber and the burner ports formed in the burner body, but removal of the burner body for cleaning of the cooking range normally required some type of tool to release a special fastener securing the burner body to the cooking range. The stamped burner designs have been manufactured such that they are removable from the range top but the designs for the crimped assemblies have severely limited access to the internal gas chamber and the inside portion of the burner ports for cleaning.

Still other prior art stamped metal burner assemblies have been developed to overcome the problems associated with the assembly and cleaning of the burners and the cooking range. These newer designs of sealed gas burners include a stamped steel base which is attached to the cooking top using a twist lock connection between the burner base and the cooking range. The twist lock feature eliminates the need for special tools for removing the burner base from the cooking range. A stamped metal burner cap engages the burner base using a fluid tight slip fit such that the burner cap can be easily removed from the burner base with its associated burner ports for cleaning. The sealed gas burner is designed to telescopically engage an air/fuel mixer tube which extends between the gas valve and the burner opening in the range top.

While the prior art sealed gas burners have performed satisfactorily for cooking ranges, the continued development of sealed gas burners has been directed to sealed gas burners which are more economical to produce while still providing all the advantages of simplicity of assembly and convenience in cleaning.

The present invention provides the art with a unique three piece stamped sealed gas burner which comprises a venturi tube, a burner cup and a burner cap. The venturi tube includes a bracket for attachment of the tube to the range top. The burner cup slidingly engages the venturi tube, which is designed to extend through the range top. The burner cup forms the bottom portion of a pocket which holds the gas and air mixture for supply to the burner ports. The burner cap is positioned over the burner cup. The burner cap includes a pair of locating posts which engage a pair of respective indentations in the burner cup to locate the burner cap with respect to the burner cup. One of the two posts serves as the grounding point for the igniter. The burner ports are formed into the lower surface of the burner cap. The sealed gas burner of the present invention provides an economical sealed gas burner which requires less assembly time and has fewer chances of having quality problems. The sealed gas burner is easier to keep clean because the burner ports are located in the burner cap and the burner cap can be easily removed for cleaning.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a top plan view of the venturi tube assembly illustrated in FIGS. 1 and 2;

DETAILED DESCRIPTION OF THE PREFERRED EMBODIMENTS

The following description of the preferred embodiment(s) is merely exemplary in nature and is in no way intended to limit the invention, its application, or uses.

Figure 1:
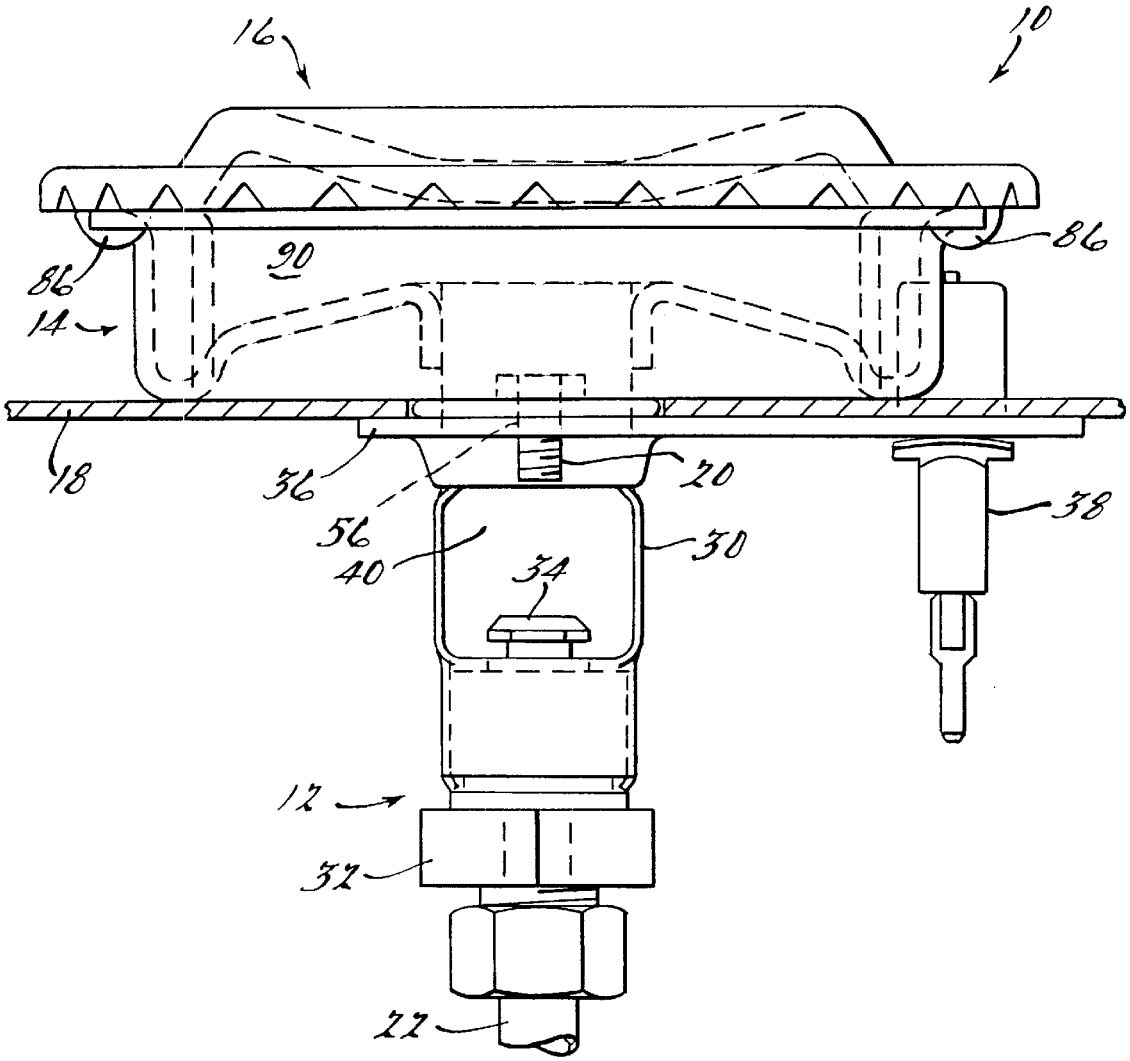
FIG. 1 is a side view of the unique sealed gas burner in accordance with the present invention.

Referring now to the drawings in which like reference numerals designate like or corresponding parts throughout the several views, there is shown in FIG. 1, a sealed gas burner in accordance with the present invention and which is designated generally by the reference numeral 10. Sealed gas burner 10 comprises a venturi tube assembly 12, a burner cup 14 and a burner cap 16. Sealed gas burner 10 is attached to a cooking range top 18 using one or more screws 20. Gas is supplied to sealed gas burner 10 through a supply tube 22 which connects sealed gas burner 10 with a supply of flammable gas (not shown) through a gas valve (not shown) as is well-known in the industry. Preferably, supply tube 22 includes a two hundred fifty thousands inch diameter tube.

Figure 2:
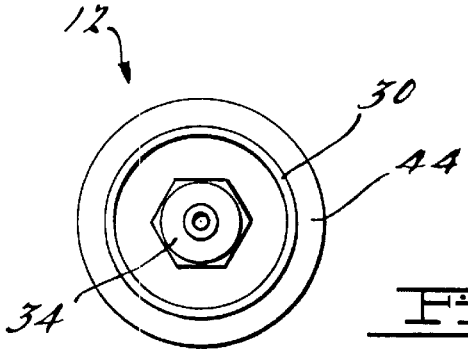
FIG. 2 is a cross-sectional side of the venturi tube assembly illustrated in FIG. 1.
Figure 2:
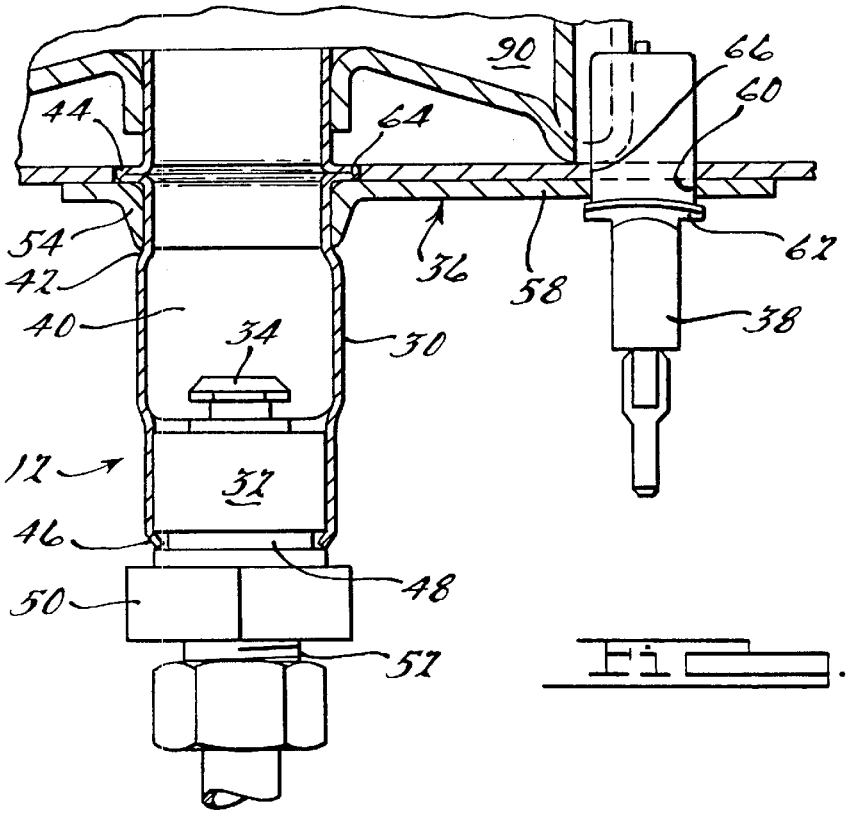

Referring now to FIGS. 1–3, venturi tube assembly 12 comprises a venturi tube 30, a gas fitting 32, a gas orifice 34, a bracket 36 and an igniter 38. Venturi tube 30 is fabricated from aluminized steel tubing. Venturi tube 30 defines two windows 40 cut into the opposite sides of venturi tube 30 to allow air to mix with the gas supplied from gas orifice 34. At the upper end of windows 40, venturi tube 30 forms a seat 42 against which bracket 36 is lcoated. Venturi tube 30 also defines a beaded section 44 which sandwiches bracket 36 between seat 42 and beaded section 44 to secure bracket 36 to venturi tube 30. Gas fitting 32 is disposed within the lower end of venturi tube 30 and the bottom end of venturi tube 30 is formed at 46 to fit within a groove 48 defined by gas fitting 32 for securing gas fitting 32 to venturi tube 30. Gas fitting 32 defines a hexagonally shaped section 50 which supports gas fitting 32 when supply tube 22 is attached to gas fitting 32 using a threaded section 52 located on the end of gas fitting 32. Gas orifice 34 is threadingly received by gas fitting 32 and it controls the amount of gas being supplied to venturi tube 30 and thus to sealed gas burner 10.

Bracket 36 defines a flange 54 which is sandwiched between seat 42 and beaded section 44 of venturi tube 30. Bracket 36 defines a plurality of threaded bores 56 (two on opposite sides of bracket 36 in the embodiment illustrated) each of which threadingly receive a respective screw 20 for securing bracket 36 and thus venturi tube assembly 12 to range top 18. Bracket 36 also includes an extending arm 58 which defines an aperture 60 within which igniter 38 is located. Igniter 38 is secured to arm 58 using a retainer 62 as is well-known in the art. Igniter 38 is attached to an electrical circuit which provides a spark for igniting the air/gas mixture as is well-known in the art. When venturi tube assembly 12 is attached to range top 18, the upper end of venturi tube 30 extends through an aperture 64 defined by range top 18 and igniter 38 extends through an aperture 66 also defined by range top 18. Beaded section 44 is designed to locate venturi tube assembly 12 within aperture 64 as is illustrated in FIGS. 1 and 2.

Figure 4:
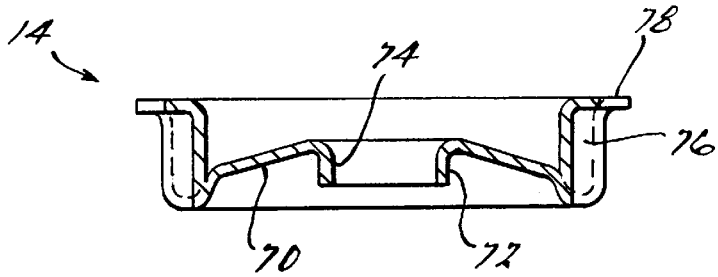
FIG. 4 is a cross-sectional side view of the burner cup illustrated in FIG. 1.
Figure 5:
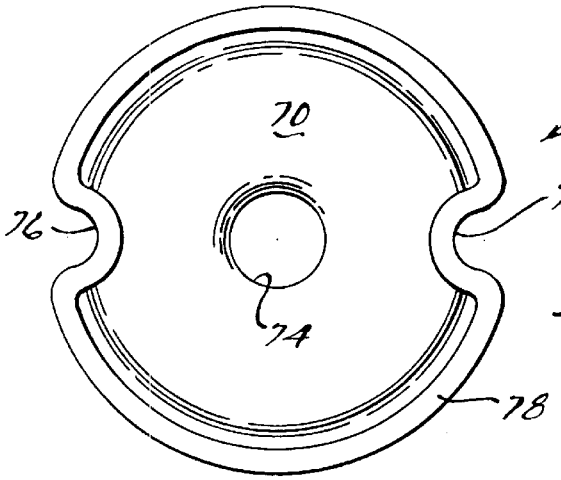
FIG. 5 is a top plan view of the burner cup illustrated in FIGS. 1 and 4.

Referring now to FIGS. 1, 4 and 5, burner cup 14 is fabricated from aluminum which is preferably forty-thousandths in thickness. The drawing operation which forms burner cup 14 draws the originally supplied material such that burner cup 14 is preferably six hundred thousandths in depth. The bottom of burner cup 14 defines an upwardly formed section 70 which helps to move the gas and air mixture to the ports as detailed below. Formed section 70 also acts to form a pocket or reservoir for the gas and air mixture to ensure an uninterrupted supply of this mixture to the ports when sealed gas burner 10 is operating on low, as well as to provide a reservoir of this mixture to dampen any pressure fluctuations. The center of formed section 70 defines a flange 72 which in turn defines an aperture 74. Aperture 74 slidingly engages venturi tube 30 of venturi tube assembly 12 with flange 72 providing a sufficient surface area of contact to avoid any significant leaking of the gas and air mixture between burner cup 14 and venturi tube 30.

The outer surface of burner cup 14 defines a pair of indentations 76 which are used to locate burner cap 16 as detailed below. One of the pair of indentations 76 is utilized as a positioning cove for igniter 38. Indentations 76 in conjunction with burner cup 14 form a location for a soft flame within the indentation that will relight sealed gas burner 10 if it goes out due to operating the burner in the low setting and opening or closing an oven door.

The upper end of burner cup 14 forms a flange 78 which is preferably one hundred twenty-five thousandths wide. Flange 78 supports burner cap 16 and with indentations 76 which are carried through flange 78, locates burner cap 16. In addition, flange 78 serves as the base for the burning ports formed in burner cap 16 as detailed below.

Figure 6:
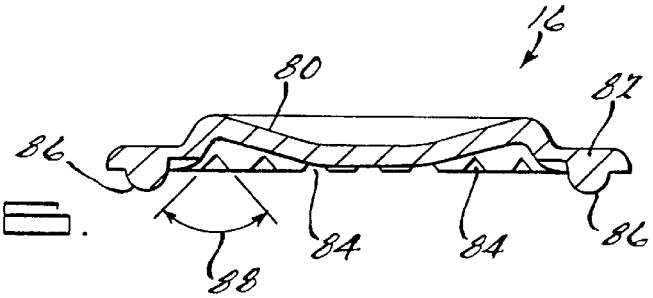
FIG. 6 is a cross-sectional side view of the burner cap illustrated in FIG. 1.
Figure 7:
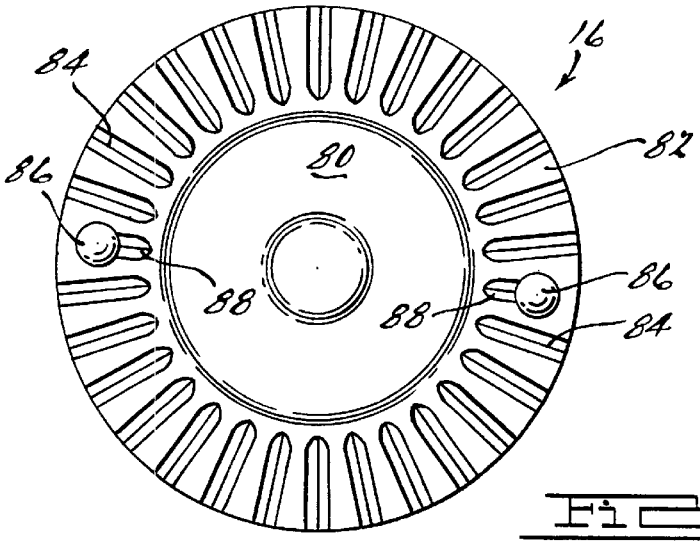
FIG. 7 is a bottom plan view of the burner cap illustrated in FIGS. 1 and 6.

Referring now to FIGS. 1, 6 and 7, burner cap 16 is formed from steel into a hat shaped disc. Preferably, burner cap 16 is one hundred forty-thousandths in thickness. Burner cap 16 defines a formed center section 80 which creates a flange 82 around the outer edge of burner cap 16. Preferably, flange 82 is one-half inch in width. A plurality (thirty to thirty-six in the preferred embodiment) of radially extending ports 84 are formed into flange 82 and a pair of locating posts 86 are formed to extend from flange 82. The base of ports 84 is provided by flange 78 on burner cup 16. Locating posts 86 engage indentations 76 on burner cup 14 to locate burner cap 16 with respect to burner cup 14. In addition, one of locating posts 86 serves as a grounding point for igniter 38 as shown in FIG. 1. The shape of locating posts 86 are designed to help direct the gas and air mixture to igniter 38.

Each of the plurality of ports 84 is a triangular shaped port having an included angle 88 preferably of forty-five degrees. The angular shape of ports 84 allows for increased spacing between adjacent ports 84. The increased spacing allows for more secondary air entrainment which is required to complete combustion. Even though the angular shape allows for increased spacing, this increase in spacing still positions adjacent ports 84 close enough to promote flame chaining. One advantage to the forty-five degree triangular shaped of ports 84 is that they allow for easier manufacturing of burner cap 16.

In addition to the plurality of radially extending ports 84, an auxiliary port 88 is formed adjacent to each locating post 86. Each auxiliary port 88 provides the gas and air mixture into a respective indentation 76 of burner cup 14. This supply of gas and air mixture results in the ignition of the flame by igniter 38 as well as maintaining a soft flame within indentations 76. This soft flame will relight sealed gas burner 10 if the burner goes out due to operation of the burner in the low setting and opening and closing the oven door.

The center of formed center section 80 is contoured downward in order to disperse the gas and air mixture directly to ports 84 and 88. The shape of the contour of formed center section 80 is designed in such a way that the gas and air mixture is directed to an annular pocket 90 (FIG. 1) formed by formed section 70 of burner cup 14 and formed center section 80 of burner cap 16. Annular pocket 90 forms a reservoir which helps to prevent sealed gas burner 10 from going out when the oven door is opened or closed by reducing the pressure fluctuations in sealed gas burner 10. This provides a more consistent flame which is less likely to be affected by the various external factors.

Sealed gas burner 10 described above, is more economical to provide and has less chance of experiencing quality problems, especially quality problems which occur due to human error. The simple design for sealed gas burner 10 will result in a significant reduction in assembly time. Once placed in service, sealed gas burner 10 is easier to keep clean because ports 84 are in burner cap 16 which is easily removable for cleaning purposes. When additional cleaning is necessary, burner cup 14 is also easily removed providing complete access to range top 18.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A gas burner assembly for a cooking range having a range top, said gas burner assembly comprising:

a venturi tube assembly comprising a venturi tube and a bracket attached to said venturi tube, said bracket being adapted to be attached directly to said range top;

a burner cup releasably attached to said venturi tube assembly, said burner cup defining an annular gas chamber in communication with said venturi tube, said burner cup being adapted to abut said range top; and a burner cap releasably attached to said burner cup, said burner cap in conjunction with said burner cup defining a plurality of burner ports in communication with said annular gas chamber.

2. The gas burner assembly for a cooking range according to claim 1 wherein:

said venturi tube is adapted to extend through said range top.

3. The gas burner assembly for a cooking range according to claim 2 wherein said venturi tube assembly further comprises an igniter attached to said bracket, said igniter being adapted to extend through said range top.

4. The gas burner assembly for a cooking range according to claim 3 wherein said igniter extends into an indentation formed within said burner cup.

5. The gas burner assembly for a cooking range according to claim 4 wherein said burner cap defines a grounding point for said igniter.

6. The gas burner assembly for a cooking range according to claim 2 wherein said burner cup slidingly engages said venturi tube.

7. The gas burner assembly for a cooking range according to claim 1 wherein said bearing cup slidingly engages said venturi tube assembly to provide said releasable attachment to said venturi tube assembly.

8. The gas burner assembly for a cooking range according to claim 1 wherein said bearing cup defines a formed bottom section which defines said annular gas chamber in communication with said plurality of burner ports.

9. The gas burner assembly for a cooking range according to claim 8 wherein said bearing cap defines a formed center section, said formed center section and said formed bottom section of said bearing cup defining said annular gas chamber.

10. The gas burner assembly for a cooking range according to claim 1 wherein said bearing cup defines a radially extending flange, said radial extending flange defining said burner ports.

11. The gas burner assembly for a cooking range according to claim 1 wherein said bearing cup defines two indentations, said bearing cap defining two locating posts, each locating post being disposed within a respective indentation.

12. The gas burner assembly for a cooking range according to claim 11 wherein said gas burner assembly further comprises an igniter disposed within one of said two indentations.

13. The gas burner assembly for a cooking range according to claim 12 wherein said igniter is attached to said venturi tube assembly.

14. The gas burner assembly for a cooking range according to claim 1 wherein said burner cap defines a plurality of radially extending grooves for defining said plurality of burner ports.

15. The gas burner assembly for a cooking range according to claim 14 wherein said plurality of radially extending grooves are disposed adjacent a radially extending flange on said burner cup for defining said plurality of burner ports.

16. The gas burner assembly for a cooking range according to claim 1 wherein said burner cap defines a formed center section which defines said annular gas chamber in communication with said plurality of burner ports.

17. The gas burner assembly for a cooking range according to claim 1 wherein said burner cap defines two locating posts, each of said locating posts engaging said burner cup to locate said burner cap with respect to said burner cup.

18. The gas burner assembly for a cooking range according to claim 17 wherein said burner cap defines an auxiliary port disposed adjacent each of said locating posts.

19. The gas burner assembly for a cooking range according to claim 18 wherein each of said locating posts is disposed within a respective indentation defined by said burner cup, said auxiliary ports being in communication with said indentations.

20. The gas burner assembly for a cooking range according to claim 19 wherein said locating ports are formed to direct fluid flow into said indentations.

21. The gas burner assembly for a cooking range according to claim 19 wherein said gas burner assembly further comprises an igniter, one of said locating posts providing a grounding point for said igniter.

22. A cooking range comprising:

a range top defining at least one venturi tube opening;

a gas burner assembly attached to said range top, said gas burner assembly comprising:

a venturi tube assembly comprising a venturi tube and a bracket attached to said venturi tube, said bracket being attached directly to a lower surface of said range top;

a burner cup releasably attached to said venturi tube assembly, said burner cup defining an annular gas chamber in communication with said venturi tube, said burner cup abutting an upper surface of said range top; and a burner cap releasably attached to said burner cup, said burner cap in conjunction with said burner cup defining a plurality of burner ports in communication with said annular gas chamber; and a gas supply tube attached to said venturi tube assembly of said gas burner assembly.

23. A cooking range according to claim 22 wherein:

said venturi tube extends through said at least one venturi tube opening defined by said range top.

24. The cooking range according to claim 23 wherein said venturi tube assembly further comprises an igniter attached to said bracket, said igniter extending through an igniter opening defined by said range top.

25. The cooking range according to claim 24 wherein said igniter extends into an indentation formed within said burner cup.

26. The cooking range according to claim 4 wherein said burner cap defines a grounding point for said igniter.

27. The cooking range according to claim 23 wherein said burner cup slidingly engages said venturi tube.

28. The cooking range according to claim 22 wherein said bearing cup slidingly engages said venturi tube assembly to provide said releasable attachment to said venturi tube assembly.

29. The cooking range according to claim 22 wherein said bearing cup defines a formed bottom section which defines said annular gas chamber in communication with said plurality of burner ports.

30. The cooking range according to claim 29 wherein said bearing cap defines a formed center section, said formed center section and said formed bottom section of said bearing cup defining said annular gas chamber.

31. The cooking range according to claim 22 wherein said bearing cup defines a radially extending flange, said radial extending flange defining said burner ports.

32. The cooking range according to claim 22 wherein said bearing cup defines two indentations, said bearing cap defining two locating posts, each locating post being disposed within a respective indentation.

33. The cooking range according to claim 32 wherein said gas burner assembly further comprises an igniter disposed within one of said two indentations.

34. The cooking range according to claim 33 wherein said igniter is attached to said venturi tube assembly.

35. The cooking range according to claim 22 wherein said burner cap defines a plurality of radially extending grooves for defining said plurality of burner ports.

36. The cooking range according to claim 35 wherein said plurality of radially extending grooves are disposed adjacent a radially extending flange on said burner cup for defining said plurality of burner ports.

37. The cooking range according to claim 22 wherein said burner cap defines a formed center section which defines said annular gas chamber in communication with said plurality of burner ports.

38. The cooking range according to claim 22 wherein said burner cap defines two locating posts, each of said locating posts engaging said burner cup to locate said burner cap with respect to said burner cup.

39. The cooking range according to claim 38 wherein said burner cap defines an auxiliary port disposed adjacent each of said locating posts.

40. The cooking range according to claim 39 wherein each of said locating posts is disposed within a respective indentation defined by said burner cup, said auxiliary ports being in communication with said indentations.

41. The cooking range according to claim 40 wherein said locating ports are formed to direct fluid flow into said indentations.

42. The cooking range according to claim 40 wherein said gas burner assembly further comprises an igniter, one of said locating posts providing a grounding point for said igniter.

* * * * *

UNITED STATES PATENT AND TRADEMARK OFFICE

CERTIFICATE OF CORRECTION

PATENT NO. : 6,736,631 B2
DATED : May 18, 2004
INVENTOR(S) : William J. Ferlin and Samuel D. Hawkins It is certified that error appears in the above-identified patent and that said Letters Patent is hereby corrected as shown below:

Column 2,
Line 57, after "side" insert -- view --.

Column 3,
Line 22, "thousands" should be -- thousandths --.

Column 4,
Line 52, "shaped" should be -- shape --.

Column 5,
Lines 56, 60, 64 and 66, "bearing" should be -- burner --.

Column 6,
Lines 2, 6 and 7, "bearing" should be -- burner --.
Line 3, "radial" should be -- radially --.

Column 7,
Lines 16, 20, 24, 26 and 28, "bearing" should be -- burner --.
Line 28, "radial" should be -- radially --.
Line 31, (two occurrences) "bearing" should be -- burner --.

Signed and Sealed this

Twenty-seventh Day of July, 2004

JON W. DUDAS
*Acting Director of the United States Patent and Trademark Office*